US006425274B1

(12) United States Patent
Laitala et al.

(10) Patent No.: US 6,425,274 B1
(45) Date of Patent: Jul. 30, 2002

(54) REKEYABLE PADLOCK WITH A LOCK CYLINDER HAVING AN ENLARGED VIEWING SLOT

(75) Inventors: Daniel A. Laitala, Bloomington; Grant T. Laitala, Savage, both of MN (US)

(73) Assignee: Abus USA, Plymouth, MN (US)

( * ) Notice: Subject to any disclaimer, the term of this patent is extended or adjusted under 35 U.S.C. 154(b) by 0 days.

(21) Appl. No.: 09/629,584

(22) Filed: Jul. 31, 2000

(51) Int. Cl.[7] ..... E05B 67/24

(52) U.S. Cl. ..... 70/394; 70/394; 70/384; 70/389; 70/51; 70/279.1; 70/364; 70/406

(58) Field of Search ..... 70/394, 38, 371, 70/386, 389, 384, 39, 51, 379 R, 370, 279.1, 406, 364, 383, 385, 100

(56) References Cited

U.S. PATENT DOCUMENTS

| | | | | | |
|---|---|---|---|---|---|
| 3,968,668 | A | * | 7/1976 | Epstein | 70/364 |
| 4,658,606 | A | * | 4/1987 | Tseng | 70/38 |
| 4,747,281 | A | * | 5/1988 | Monahan | 70/383 |
| 4,836,002 | A | | 6/1989 | Monahan | 70/382 |
| 5,174,136 | A | * | 12/1992 | Thwing | 70/371 |
| 5,363,678 | A | * | 11/1994 | Meckbach | 70/38 |
| 5,377,511 | A | * | 1/1995 | Meckback | 70/38 |
| 5,752,400 | A | | 5/1998 | Kim | 70/368 |
| 5,921,123 | A | | 7/1999 | Schwarzkopf et al. | 70/371 |
| 6,035,673 | A | * | 3/2000 | Harrison | 70/100 |
| 6,237,379 | B1 | * | 5/2001 | Hotzl | 70/279 |

OTHER PUBLICATIONS

Instruction sheet for Schlage or Baldwin Version padlocks.

* cited by examiner

*Primary Examiner*—William A. Cuchlinski, Jr.
*Assistant Examiner*—Tuan C To
(74) *Attorney, Agent, or Firm*—Merchant & Gould P.C.

(57) ABSTRACT

This invention pertains to the lock cylinder of a rekeyable padlock. According to a preferred embodiment of the present invention, a rekeyable padlock is provided with a lock cylinder formed within. The lock cylinder includes a cylindrical core formed to receive a key and an outer casing formed around the core. A viewing opening is formed within the casing wall, the viewing opening allowing access to pin openings formed within the core to receive selected pins. The viewing opening is shaped such that it provides a viewing area larger than the pin openings, thereby allowing greater visibility when the pins are placed within the pin openings. The advantages of this viewing opening include greater ease in placing the pins into the pin openings and easier detection when a selected pin is the wrong length and does not sit flush within the lock cylinder core.

13 Claims, 4 Drawing Sheets

REKEYABLE PADLOCK WITH A LOCK CYLINDER HAVING AN ENLARGED VIEWING SLOT

I. BACKGROUND OF THE INVENTION

1. Field of the Invention

This invention pertains to padlocks. More particularly, this invention pertains to the lock cylinder of a rekeyable padlock.

2. Description of the Prior Art

Padlocks are commonly used to secure belongings in structures such as sheds, trunks, lock boxes, and the like. One type of padlock is a combination padlock in which a combination (i.e., a unique code typically represented by numbers) is used to unlock the padlock. However, several problems may occur with combination padlocks. The user may forget the combination, and, therefore, be unable to open the padlock. The user may write down the combination, which could compromise the security of the lock. In addition, if the lock is not used often, the user may forget where the written combination was stored.

A keyable padlock is another common type of padlock. Keyable padlocks are advantageous over combination padlocks because keyable padlocks do not require memorization of a combination. Rather, a key is used to unlock the padlock. However, the user of a keyable padlock must either store the padlock key in a place that is easy to remember, or carry the padlock key with other commonly used keys. Storing the padlock key increases the risk that the user will forget where the padlock key is stored or that the padlock key will not be found again. Carrying the padlock key with other commonly used keys, however, increases the bulk of the user's key chain and can be a source of irritation if the user has multiple padlock keys for multiple padlocks.

Keyable padlocks are known in the art, such as the ones described in U.S. Pat. Nos. 5,363,678 and 5,377,511 issued to Meckbach on Nov. 15, 1994 and Jan. 3, 1995, respectively, and hereby incorporated by reference in their entirety. Keyable padlocks such as these are not typically sold to end users, but rather are first "keyed" by a locksmith and then sold to users. The padlocks are provided to a locksmith with a zero-bitted key, meaning that the key has two long, generally parallel edges with no cuts. The locksmith removes a cylinder of the padlock body and then inserts the zero-bitted key into a rotatable core of the cylinder. A stop pin limits rotation of the rotatable core of the cylinder. The stop pin must be removed from the cylinder in order to complete the rotation of the core to align the key opening with a longitudinal row of pin openings in an outer casing of the cylinder. Generally, tweezers, pliers, or another similar tool can be used to remove the stop pin from the cylinder.

The locksmith determines a pin sequence for each padlock. Specifically the locksmith selects a predetermined number of pins to insert in the pin openings of the cylinder, with each pin having a specific length and with the pins ordered in a particular sequence. Generally, a padlock cylinder accommodates between 3 and 7 pins. It is desirable for the pins to be small in length and width because a padlock's security increases as the number of pins used in the pin sequence increases. Thus, a padlock accommodating a seven-pin pin sequence has a higher level of security than a padlock accommodating only a three-pin pin sequence.

It is also desirable to have multiple pin lengths from which to choose, because this also enhances the security of the padlock. Typically, the pins used in a pin sequence are selected from a group of pins having a variety of pin lengths. For example Schlage® padlocks accommodate ten different pin lengths, although generally the zero-bit is not used. Therefore, pins are selected for the pin sequence from the remaining nine of the ten pin lengths. In another example, Kwikset® padlocks accommodate six different pin lengths.

As the pins become smaller and as the number of pins used and the number of variations of pin lengths increases, however, the more difficult it becomes to differentiate pins having the different pin lengths. In some prior art padlocks, such as the Schlage® padlocks, the variation between successive pin lengths is not more than 0.015 inches. In other prior art padlocks, such as Kwikset® padlocks, the pin lengths will vary between 0.021 and 0.027 inches between successive pin lengths. With such small variations in pin length, special tools are needed to differentiate between the lengths of the pins. Other systems, such as that illustrated in U.S. patent Ser. No. 09/561,157, filed Apr. 28, 2000, hereby incorporated by reference in its entirety, uses color coding to differentiate between the lengths of pins.

After the pin sequence is selected and before inserting the pins through the pin holes, the zero-bitted key is removed from the key opening and one edge of the key is cut such that the number, size, and order of cuts in the edge of the key correspond to the number, length, and order of the pins of the selected pin sequence. The cut key is then inserted into the key opening and the selected pins are inserted into the pin openings in the specified order of the pin sequence. After all of the pins are inserted, a shear line is formed and the key is rotated. Once the stop pin opening is accessible, the stop pin must be inserted back into the stop pin opening and the key is rotated until the pins are aligned with bottom pins and springs that prevent rotation of the cylinder core without the matching key.

The relatively small size of the pins, in addition to the small differences in length of the pins, make the process of selecting the pin lengths, arranging the pins in the selected sequence, and cutting a key to correspond to the selected pin lengths and sequence, a painstaking task. The placement of a pin that is even one size too short into one of the pin openings could result in a cylinder core that cannot be turned with the cut key. In such a situation, the cut key would be able to turn the cylinder core until the pins were aligned with the springs and bottom pins that prevent rotation of the cylinder core without the matching key. Once the pins in the cylinder were aligned with the springs and bottom pins, however, the key would not be able to turn the cylinder core to unlock the padlock, nor would it be able to turn the cylinder core to replace the short pin to match its corresponding key cut. Because of the high level of accuracy needed to ensure that the lengths and sequence of the pins match the depths and sequence of the cuts in the key, padlocks of this type are not typically sold directly to consumers. In addition, most consumers have to go to a hardware store or the like in order to use key cutting machines. Therefore, these types of padlocks are not sold to consumers until after a locksmith has keyed the lock and ensured that it is operational with the provided key.

What is needed is a simplified method and padlock that enables a consumer to key the padlock to a particular key that is already cut and that is selected by the user. For example, if a consumer purchases one or more padlocks, it is desirable that the consumer be able to key each of the padlocks to operate with a particular key, such as the consumer's house key. Thus, the consumer would not have to maintain separate and additional keys for each individual padlock.

The present invention provides a solution to these and other problems and offers other advantages over the prior art, as will be understood with reference to the summary, the detailed description and the drawings.

II. SUMMARY OF THE INVENTION

According to a preferred embodiment of the present invention, a rekeyable padlock is provided with a lock cylinder formed within. The lock cylinder includes a cylindrical core formed to receive a key and an outer casing formed around the core. A viewing opening is formed within the casing wall, the viewing opening allowing access to pin openings formed within the core to receive selected pins. The viewing opening is shaped such that it provides a viewing area larger than the pin openings, thereby allowing greater visibility when the pins are placed within the pin openings. The advantages of this viewing opening include greater ease in placing the pins into the pin openings and easier detection when a selected pin is the wrong length and does not sit flush within the lock cylinder core.

III. BRIEF DESCRIPTION OF THE DRAWINGS

Figure 10:
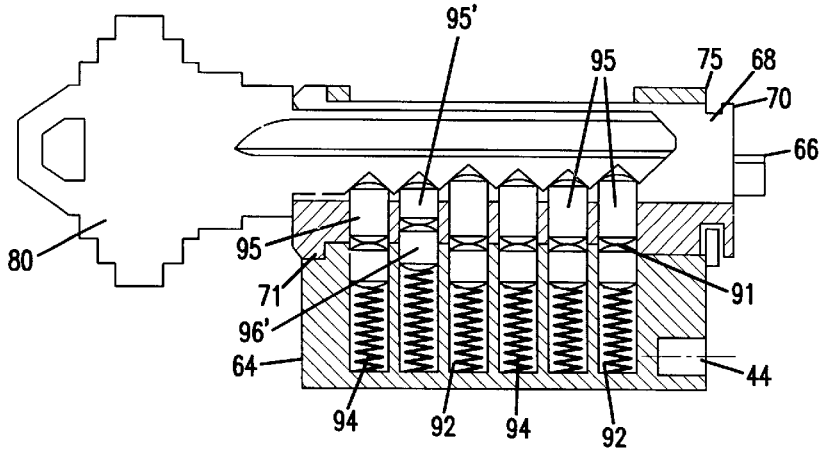

FIG. 10 a side view in vertical section of the lock cylinder in a locked position taken generally longitudinally through the viewing opening, with a key inserted and a pin of incorrect length selected.

IV. DESCRIPTION OF THE PREFERRED EMBODIMENT

Referring now to the several drawing figures in which identical elements are numbered identically throughout, a description of the preferred embodiments will now be provided. In providing such a description, specific methods and parts of the invention will be described. It will be appreciated that variants (some of which will be later described) of such specifics are intended to be included within the scope of the appended claims.

Figure 1:
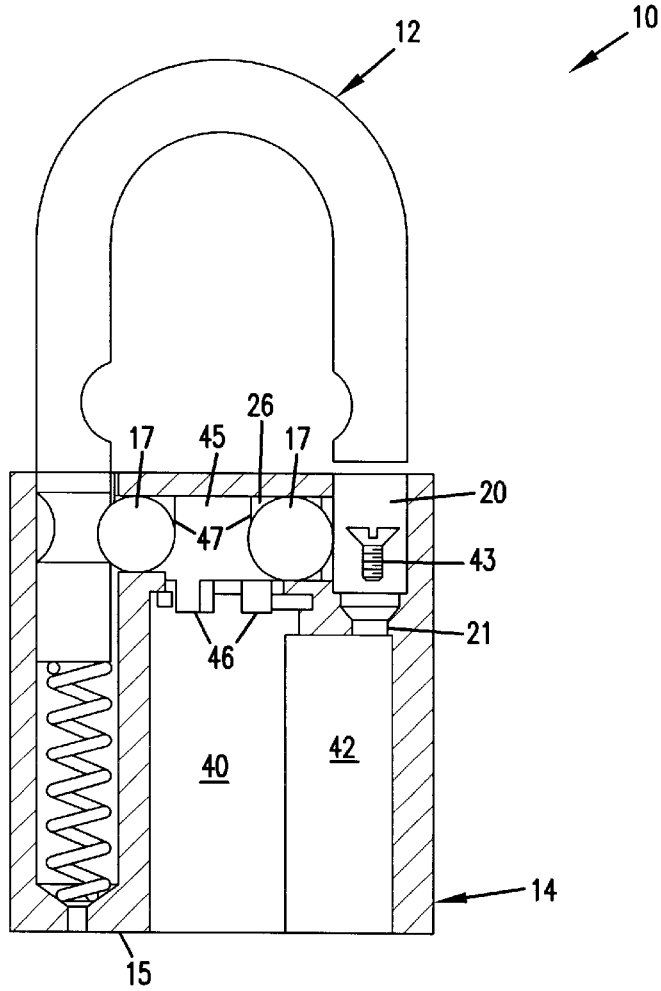
FIG. 1 is a view in vertical section of a padlock with a lock cylinder exploded therefrom according to the present invention.
Figure 1:
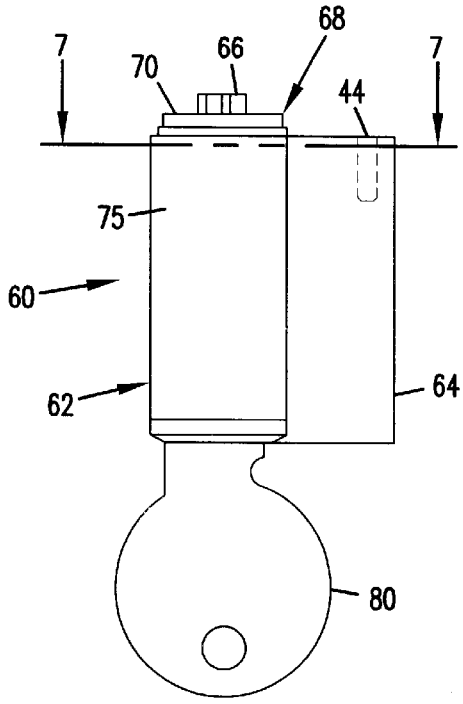

Referring to FIG. 1, a rekeyable padlock 10 is shown. The padlock shown has a padlock body 14 with generally the same configuration as the ones described in U.S. Pat. Nos. 5,363,678 and 5,377,511, previously incorporated by reference herein. A description of the padlock 10, shown in FIG. 1 follows. However, it will be apparent that a variety of configurations of the actual padlock body 14 can by used in accordance with the present invention.

The padlock 10 includes a U-shaped shackle 12 and a removable lock cylinder 60 that fits within the padlock body 14. The padlock body 14 defines a central cylindrical bore 40 and an eccentric bore 42 adjacent to the central bore 40. The central bore 40 extends from a bottom face 15 of the padlock body to transverse bore 26. The eccentric bore 42 extends from the bottom face 15 to just below bottom end 21 of bore 20. A removable threaded screw 43 extends through the bottom end 21 of the bore 20 and engages a threaded bore 44 of the lock cylinder 60 to retain the lock cylinder 60 within the padlock body 14. The screw 43 can be removed, and the lock cylinder 60 thereby released from the padlock body 14, only when the shackle 12 is open.

The cylindrical bore 40 and eccentric bore 42 are formed to accommodate the lock cylinder 60, which has a corresponding cross section. The lock cylinder 60 has a cylindrical portion 62 and an attached spring-holding portion 64, which together generally form a FIG. 8 cross section. The cylindrical portion 62 has a rotatable cylindrical core 68 and entrainment projections 66 that extend upwardly from an upper end 70 of the core 68.

After a key 80 is inserted into the core 68 of the lock cylinder 60, and while the key 80 is being rotated from a locked position to an unlocked position, entrainment projections 66 of the lock cylinder 60 engage the entrainment projections 46 of element 45 positioned within transverse slot 26. The element 45 is thereby rotated until its grooves 47 and 47' receive portions of balls 17 and 17', respectively, so that the shackle 12 is free to move upwardly until the lock is opened.

Figure 3:
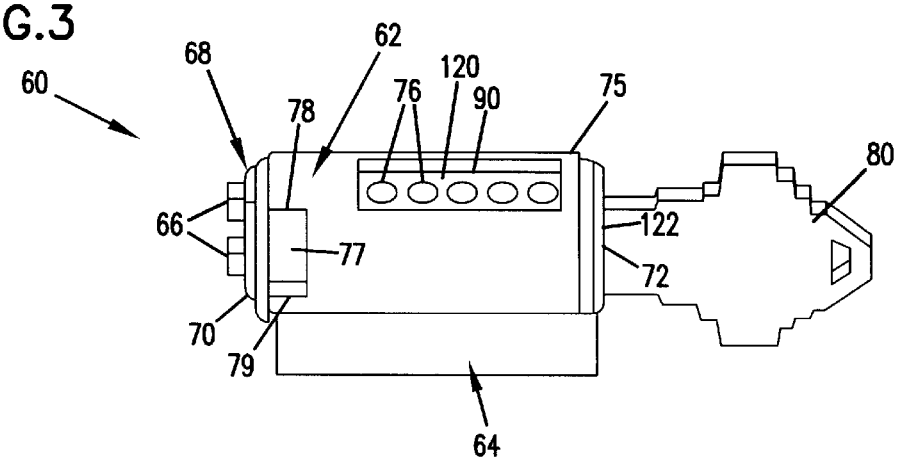
FIG. 3 is a top, side perspective view of the lock cylinder in a rekeyable position shown with the viewing opening aligned with pin openings for receiving pins.
Figure 4:
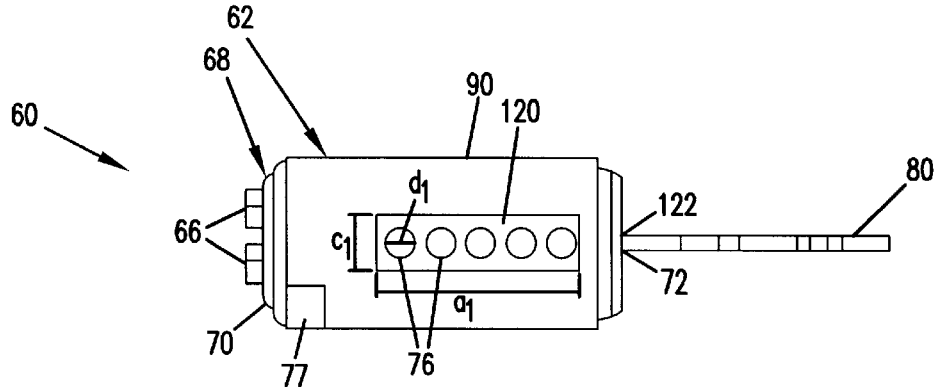
FIG. 4 is a top view of the lock cylinder in a rekeyable position shown with the viewing opening aligned with pin openings for receiving pins.
Figure 5:
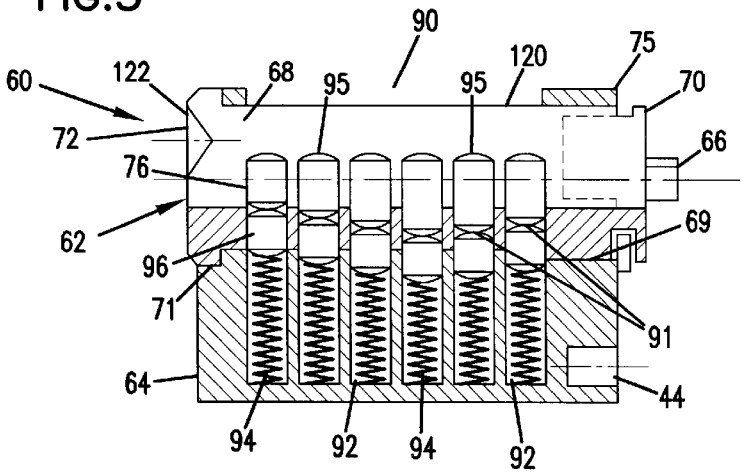
FIG. 5 is a side view in vertical section of the lock cylinder in a locked position taken generally longitudinally through the viewing opening.

Referring now to FIGS. 2–5, the lock cylinder 60 is shown in isolation from the padlock body 14. The core 68 is generally cylindrical and includes a cylindrical outer surface 120 and an end face 122. As best shown in FIG. 5, a key opening 72 extends from the end face 122 axially into the core 68. The core 68 also defines a plurality of pin openings 76 that extend radially through the core 68 between the outer surface 120 and the key opening 72.

The cylindrical portion 62 of the lock cylinder 60 also includes a casing portion formed by a casing wall 75. The casing wall 75 defines a cylindrical inner chamber in which the core 68 is rotatably mounted.

Figure 2:
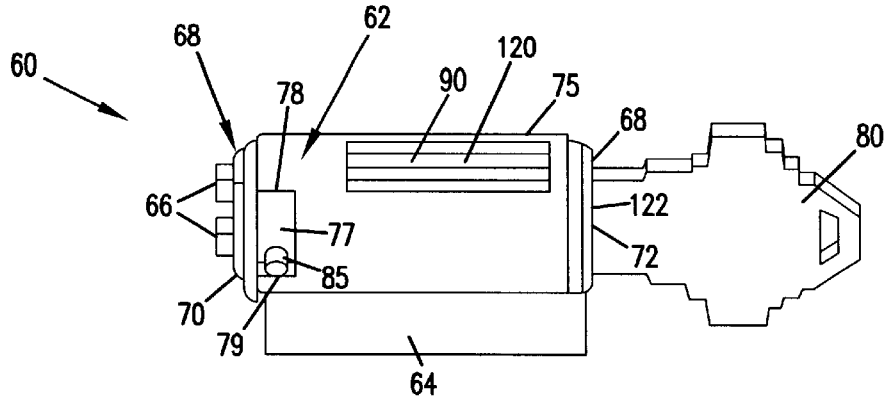
FIG. 2 is a top, side perspective view of the lock cylinder shown in a locked position.
Figure 7:
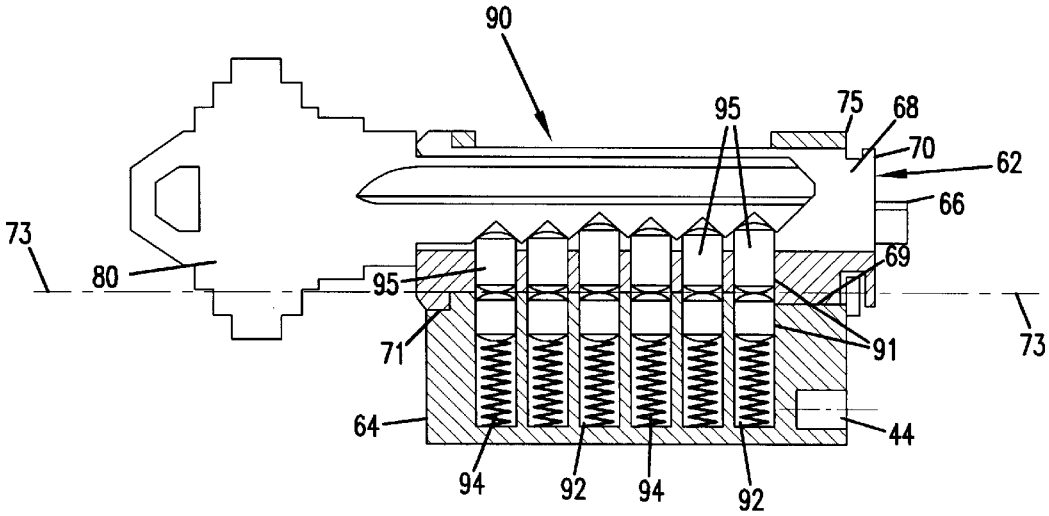
FIG. 7 is a side view in vertical section of the lock cylinder in a locked position taken generally longitudinally through the viewing opening with key inserted.

A viewing opening 90 is arranged as a longitudinal slot defined through the casing wall 75. In one preferred embodiment described below, the viewing opening is formed as a continuous slot defined through the casing wall 75. However, the viewing opening may be formed in different shapes and with different dimensions, and more than one viewing slot may be formed within outer casing 75 without departing from the spirit of the present invention. In one preferred embodiment, the viewing opening 90 is positioned approximately 180 degrees around the cylindrical portion 62 from a longitudinal center of the spring-holding portion 64. In the normally locked position of the core 68, as shown in FIGS. 2, 5, and 7, the pin openings 76 align with the longitudinal center of the spring-holding portion 64. By rotating the core 68 180 degrees relative to the casing wall 75, the core can be placed in a rekeyable position in which the pin openings 76 align with the viewing opening 90 (see FIGS. 3, 4, and 8).

The casing wall 75 includes a generally rectangular cutout 77 adjacent the upper end 70 of the core 68. As shown in FIG. 2, a portion of a stop pin 85 extends into the cutout 77 of the outer casing 75. The cutout 77 forms opposing first and second edges 78 and 79 in the outer casing 75 that limit rotation of the core 68 when the stop pin 85 abuts either of the edges 78 or 79 as shown in FIG. 2.

Figure 8:
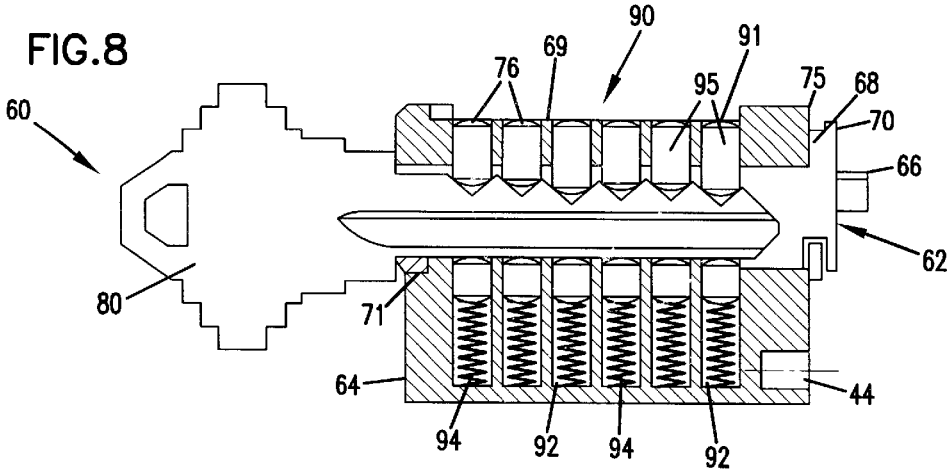
FIG. 8 is a side view in vertical section of the lock cylinder in a rekeyable position taken generally longitudinally through the viewing opening, including a key and pins positioned within the lock cylinder.

When the stop pin 85 abuts the first edge 78, the core 68 is aligned in the normally locked position of FIGS. 2, 5, and 7. The stop pin 85 abuts the second edge 79 of the cutout 77 to prevent unlimited rotation when the core 68 is rotated (e.g., by key 80 away from the locked position). In one preferred embodiment, the core rotates about 58° between the two edges 78 and 79. The stop pin 85 may be depressed until it is flush with the outer surface 120 of the core 68. Thus, when the stop pin 85 is depressed, the core 68 may continue to be rotated beyond the limited range set by the edges 78 and 79. This allows the core 68 to be rotated until the core 68 is positioned such that the row of pin openings 76 is visible through viewing opening 90, as shown in FIGS. 3, 4, and 8. The stop pin 85 of the present invention, therefore, allows quick and easy access to the pin openings without having to use a tool to remove the stop pin, and without having to safeguard the stop pin when rekeying the padlock 10.

As shown in FIG. 3, depressing the stop pin 85 permits rotation of the core 68 into the rekeyable position. In the rekeyable position, pin openings 76 are longitudinally aligned along viewing opening 90. This allows the lock to be keyed by inserting pins 95 through the viewing opening 90 into the pin openings 76. In the preferred embodiment, the viewing opening 90 in outer casing 75 is formed such that its circumferential dimension $c_1$ and axial dimension $a_1$ are larger than a diameter $d_1$ of each pin opening 76, as shown in FIG. 4. Hence, when rekeying, a user can view portions of the outer surface 120 that surround the pin openings 76.

FIG. 5 shows a cross-sectional view of the lock cylinder 60 in the locked position with a selected pin sequence. As is known in the art, the spring holding portion 64 of the lock cylinder 60 defines a plurality of radial bores 92 each provided with a coil spring 94 and a pin spacer 96 (i.e., a locking pin). When the core 68 of the cylindrical portion 62 is in the normally locked position, the radial bores 92 align with the pin openings 76. Thus, each of the radial bores 92 is in axial alignment with one of the pins 95. This causes the pins 95 to be biased upwardly by the coil springs 94 when no key is in the lock.

Figure 6:
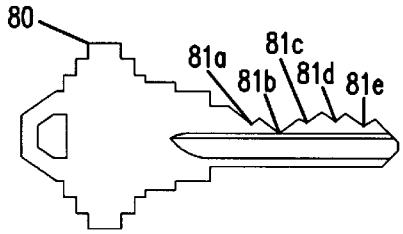
FIG. 6 is a plan view of a key having selected cuts and a selected cut sequence.

When key 80 is inserted in the key opening 72, the cuts 81*a*–81*e* of the key 80 (shown in FIG. 6) complement the pins 95 such that an outwardly facing end 91 of each of the pins 95 is flush with the outer surface 120 of the core 68 (see FIG. 7). If the pins 95 have the appropriate lengths that correspond to the cuts 81*a*–81*e*, the pins 95 hold the pin spacers 96 flush with the outer surface 120 of the core 68 when the key 80 is inserted in the key hole 72 (see FIG. 7). If any one of the cuts of the key 80 does not match its corresponding pin 95, then, depending on the type of mismatch, either the extension of the corresponding pin spacer 96 and coil spring 94 into the core 68 or the extension of the pin 95 into the radial bore 92 will prevent rotation of the core 68.

FIG. 8 shows a cross-sectional view of the lock cylinder 60 with the core 68 in the position to rekey the lock. The pin openings 76 are visible through the viewing opening 90. When rekeying a lock, a pin sequence is selected. The pin sequence includes a particular number of pins 95 with selected pin lengths. The key 80 is cut in a cut sequence corresponding to the selected pin sequence. Each cut 81*a*–81*e* of the key 80 corresponds to one of the selected pins in the pin sequence. The key 80 is inserted into the key opening 72 of the lock cylinder 60 and the selected pins 95 are inserted into the pin openings 76. The key 80 is then used to rotate the core 68 back to the normally locked position as shown in FIG. 1.

Generally, a pin sequence may be selected by choosing pins from a variety of lengths that the lock cylinder 60 can accommodate. For example, in one preferred embodiment of the present invention, the lock cylinder 60 can accommodate ten different pin lengths, and thus, the cuts of the key 80 can be selected from ten different cut sizes that correspond to the ten different pin lengths.

Figure 9:
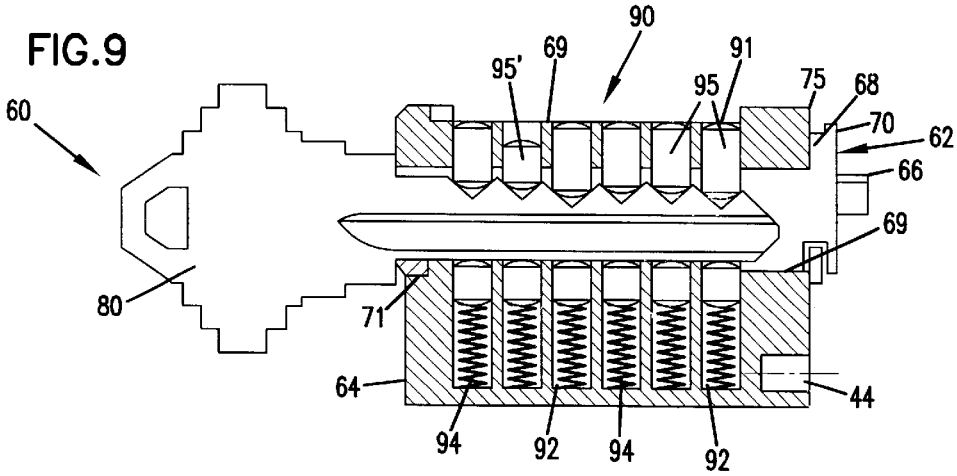
FIG. 9 is a side view in vertical section of the lock cylinder in a rekeyable position taken generally longitudinally through the viewing opening, with a pin of incorrect length selected.

When inserted in the key opening 72, the cuts 81*a*–81*e* of the key 80 complement the pins such that each of the pins has an outer end that is flush with an outer circumference of the core 68, forming a shear line 73 so that the core 68 can be rotated (see FIG. 7). If any one of the cuts of the key 80 does not match its corresponding pin 95, the lock will not operate. For example, if too long a pin 95 is used, the pin 95 will project beyond the outer surface 120 of the core 68. Thus, if a user attempts to return the 68 to the locked position, the pin 95 will engage the casing wall 75 and prevent rotation of the core 68. By contrast, if too short a pin 95 is used, the end of the pin 95' will be recessed within the core 68 (see FIG. 9). With too short a pin 95', the user can rotate the core 68 to the locked position without interference from the pin 95'. However, once the core 68 is turned to the locked position, the pin spacer 96' aligned with the short pin 95' is biased into the corresponding pin hole 76 thereby preventing the key 80 from opening the lock (see short pin 95' and pin spacer 96' of FIG. 10).

It will be apparent to those skilled in the art that the pin openings 76 could be longitudinally aligned at various positions along the cylindrical portion 62.

There are several advantages to the shape of viewing opening 90. First, because viewing opening 90 is formed such that it is larger than each pin opening 76, as shown in FIG. 4, insertion of the pins 95 into the pin openings 76 is made easier. Second, the larger viewing area provided by viewing opening 90 allows for easier detection of mistakes made in the selection of pin sizes. Prior cylinders included openings over the pin openings that were identical in circumference to the pin openings, making it difficult to determine if an inserted pin was sitting flush with the outer surface 120 of the rotatable core 68. The larger viewing opening 90 makes it less likely that a pin with an improper length will be selected and used (see FIG. 9) because a user can see the outer surface 120. Thus, the user can view the ends of the pins 95 in relation to the outer surface 120 to make sure the pins are flush with the outer surface 120.

From the foregoing, it has been shown how the present invention has been attained in a preferred embodiment. Modifications and equivalents of the disclosed concepts, such as those which are apparent to one skilled in the art, are intended to be included within the scope of the appended claims.

What is claimed is:

1. A lock cylinder for a rekeyable padlock, the lock cylinder comprising:

a cylindrical core having a cylindrical outer surface and an end face, the cylindrical core defining a key opening sized for receiving a key, the key opening extending from the end face axially into the cylindrical core, the cylindrical core also defining a plurality of first pin openings that extend radially through the cylindrical core between the cylindrical outer surface and the key opening, each pin opening having a diameter $d_1$;

a casing including a casing wall defining a cylindrical inner chamber in which the cylindrical core is mounted, the casing defining at least one viewing opening defined through the casing wall, the viewing opening having at least one dimension that is larger than the diameter $d_1$;

a spring holder connected to the casing, the spring holder defining a plurality of second pin openings exposed to the inner chamber of the casing, the second pin openings extending in a radial direction relative to the cylindrical core;

a plurality of pins mounted within the second pin openings, the pins being spring biased toward the cylindrical core; and the cylindrical core being moveable within the casing between a locked position in which the first pin openings align with the second pin openings, and a rekeyable position in which the first pin openings can be viewed through the viewing opening.

2. The lock cylinder of claim 1, wherein the dimension of the viewing opening extends in a circumferential direction relative to the cylindrical core.

3. The lock cylinder of claim 1, wherein the dimension of the viewing opening extends in an axial direction relative to the cylindrical core.

4. The lock cylinder of claim 1, wherein the viewing opening comprises a single viewing window sized to expose all of the first pin openings.

5. The lock cylinder of claim 4, wherein the viewing window comprises a rectangular slot.

6. The lock cylinder of claim 1, wherein the viewing opening includes a circumferential dimension $c_1$ that is larger than the diameter $d_1$.

7. The lock cylinder of claim 1, wherein the viewing opening includes an axial dimension $a_1$ that is larger than the diameter $d_1$.

8. The lock cylinder of claim 1, wherein the viewing opening includes a circumferential dimension $c_1$ that is larger than the diameter $d_1$, and an axial dimension $a_1$ that is larger than the diameter $d_1$.

9. The lock cylinder of claim 8, wherein the axial dimension $a_1$ is large enough for the viewing opening to encompass all of the first pin openings.

10. The lock cylinder of claim 1, further comprising a plurality of pins mountable in the first pin openings by inserting the pins through the viewing opening.

11. The lock cylinder of claim 10, wherein the pins are color coded based on length.

12. A rekeyable padlock comprising:

a padlock body, the padlock body formed to accept a removable lock cylinder;

a shackle, the shackle formed as an integral part of the padlock body, the shackle being situated to move from a locked position to an unlocked position;

a key;

the removable lock cylinder, the removable lock cylinder comprising:

a cylindrical core having a cylindrical outer surface and an end face, the cylindrical core defining a key opening sized for receiving the key, the key opening extending from the end face axially into the cylindrical core, the cylindrical core also defining a plurality of first pin openings that extend radially through the cylindrical core between the cylindrical outer surface and the key opening, each pin opening having a diameter $d_1$;

a casing including a casing wall defining a cylindrical inner chamber in which the cylindrical core is mounted, the casing defining at least one viewing opening defined through the casing wall, the viewing opening having at least one dimension that is larger than the diameter $d_1$;

a spring holder connected to the casing, the spring holder defining a plurality of second pin openings exposed to the inner chamber of the casing, the second pin openings extending in a radial direction relative to the cylindrical core;

a plurality of pins mounted within the second pin openings, the pins being spring biased toward the cylindrical core; and the cylindrical core being moveable within the casing between a locked position in which the first pin openings align with the second pin openings, and an unlocked position in which the first pin openings can be viewed through the viewing opening.

13. A method of rekeying a padlock for a key selected by a user, the key having cut depths, the method comprising:

providing a padlock, the padlock including a cylinder body having a cylindrical core with a key opening sized to receive the selected key, the padlock also including a casing that surrounds at least a portion of the core and defines a viewing opening;

selecting a plurality of pins having a plurality of lengths corresponding to the cut depths of the cuts formed in the selected key;

inserting the selected key into the key opening of the cylindrical core;

inserting the selected plurality of pins into the cylindrical core through the viewing opening such that each of the pins fits within the cut of the selected key having the cut size to which the pin corresponds;

examining the selected plurality of pins seated within the cylindrical core as well as a portion of an outer surface of the cylindrical core through the viewing opening; and comparing the end of each pin to the outer surface of the cylindrical core through the viewing opening to verify that each pin forms a shear line at the outer surface of the cylindrical core.

* * * * *